US005643047A

United States Patent [19]

Beckett et al.

[11] Patent Number: 5,643,047

[45] Date of Patent: Jul. 1, 1997

[54] MOBILE FLOOR GRINDING VEHICLE

[75] Inventors: Leonard James Beckett, High Wycombe; Kevin Dare, Huddersfield, both of Great Britain

[73] Assignee: Concrete Grinding Ltd., High Wycombe, United Kingdom

[21] Appl. No.: 507,716

[22] Filed: Jul. 26, 1995

Related U.S. Application Data

[63] Continuation of Ser. No. 30,389, filed as PCT/GB91/01317 Aug. 1, 1991 published as WO92/02334 Feb. 20, 1992, abandoned.

[30] Foreign Application Priority Data

Aug. 1, 1990 [GB] United Kingdom ..... 9016897

[51] Int. Cl.[6] ..... B24B 49/12

[52] U.S. Cl. ..... 451/6; 451/353

[58] Field of Search ..... 451/6, 353, 350, 451/24; 125/25, 38

[56] References Cited

U.S. PATENT DOCUMENTS

| | | | |
|---|---|---|---|
| 3,129,539 | 4/1964 | Tempero | 51/177 |
| 5,140,776 | 8/1992 | Isdahl et al. | 51/165.72 |

FOREIGN PATENT DOCUMENTS

| | | | |
|---|---|---|---|
| B-43 927/79 | 8/1979 | Australia . | |
| B-57942/80 | 2/1981 | Australia . | |
| 2270380 | 12/1975 | France . | |
| 2523375 | 12/1976 | Germany | 51/165.72 |

OTHER PUBLICATIONS

Abstract of FR2270380 (Dec.–1975).

*Primary Examiner*—Robert A. Rose
*Attorney, Agent, or Firm*—Vidas, Arrett & Steinkraus

[57] ABSTRACT

A mobile floor grinding vehicle for grinding a floor to a predetermined level and provided with one or more grinding heads which can be continuously adjusted as the vehicle is moved over a floor to maintain the grinding surface of the heads at a fixed position corresponding to the contour to be ground in the floor. Positional control of the heads is effected either by a laser beam from a laser source positioned remote from the vehicle and providing a datum level against which the operative position of the grinding heads is continuously monitored and adjusted using laser beam responsive sensors, or by means of signals generated by an on-board computer which vary in accordance with the initial contours of the floor measured against its desired contours and pre-programmed into the computer.

12 Claims, 8 Drawing Sheets

19
6
18
13
25
19
6
18
4
10
22
11
4
13
23
25
11
27
12
14

MOBILE FLOOR GRINDING VEHICLE

The present application is a continuation of 08/030,389, filed as PCT/GB01317 Aug. 1, 1991 published as WO92/02334 Feb. 20, 1992, now abandoned.

FIELD OF THE INVENTION

The present invention relates to vehicles for grinding floors to a predetermined contour, for example, in order to produce a substantially perfect flat surface on a concrete floor.

BACKGROUND OF THE INVENTION

The achievement of a perfect flat surface on a concrete floor is particularly important in large industrial buildings such as warehouses, where flatness is required to enable forklift trucks to pass safely and efficiently over the floor, remaining perfectly level even when heavily loaded. It is also often necessary to provide an accurately flat floor on which to attach heavy machine tools. In addition, where goods are to be stacked, the floor must be substantially perfectly level to avoid any danger of a stack toppling.

At the present time, the required flatness has been produced by manual techniques which, while producing the results desired, nevertheless are laborious, labour intensive and time consuming and, therefore, costly.

SUMMARY OF THE INVENTION

It is an object of the invention to overcome the disadvantages of the prior art and to provide a mechanised means for grinding floors to a predetermined contour.

According to the invention there is provided a mobile floor grinding vehicle comprising a vehicle body movable in a predetermined direction of travel over a floor, a pair of grinding tools supported by the body placed at a spacing between them, means for varying the spacing between the tools, drive means for driving each grinding tool to grind the floor to a desired contour, and control means for controlling the grinding depth of each grinding tool with respect to the floor in response to predetermined signals representative of said desired contour.

Preferably two support arms each carrying a grinding tool are mounted at either side of the vehicle body so as to swing outwardly with respect thereto in order to provide an adjustable transverse spacing between the grinding tools.

Alternatively, each grinding tool may be mounted on a transverse beam, preferably provided with lengthwise adjustability, again so that the transverse position of the grinding tools can be accurately set.

The vehicle is preferably self-propelled, for example by means of electric, hydraulic or diesel traction motors. Electrical power may be obtained from batteries carried by the vehicle.

The control means may be responsive to a signal representing a single predetermined datum level. A typical example is a horizontal laser beam from a fixed external source, detected by a sensor on the vehicle which transmits appropriate signals to the control means to regulate the height of the grinding tools in relation to the datum level.

Alternatively, and preferably in addition, the vehicle includes a computer which is pre-programmable to control the control means in accordance with a predetermined pattern, e.g., in accordance with data representing the initial contours of the floor and its desired final contours. In the latter case, the vehicle is self-propelled, and the computer is linked to the propulsion means of the vehicle so as to control the vertical position of the grinding heads in such a way as to compensate for variations in the initial contours and thereby grind the floor to the required degree of flatness.

BRIEF DESCRIPTION OF THE DRAWINGS

An embodiment of the invention will now be described, by way of example only and with reference to the accompanying drawings, in which.

PREFERRED EMBODIMENTS OF THE INVENTION

Figure 1:
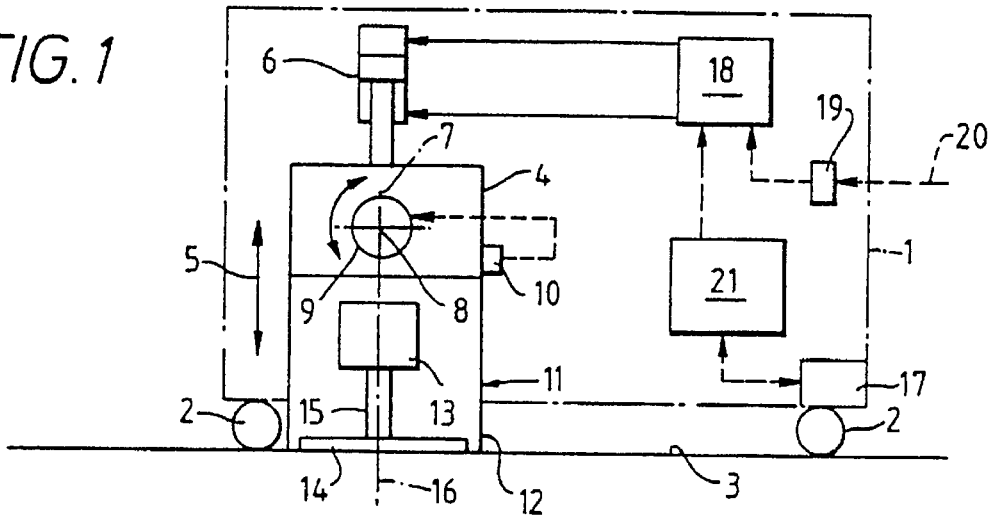
FIG. 1 is a diagram illustrating, in notional elevation, principal component parts of the vehicle in a first embodiment.
Figure 2:
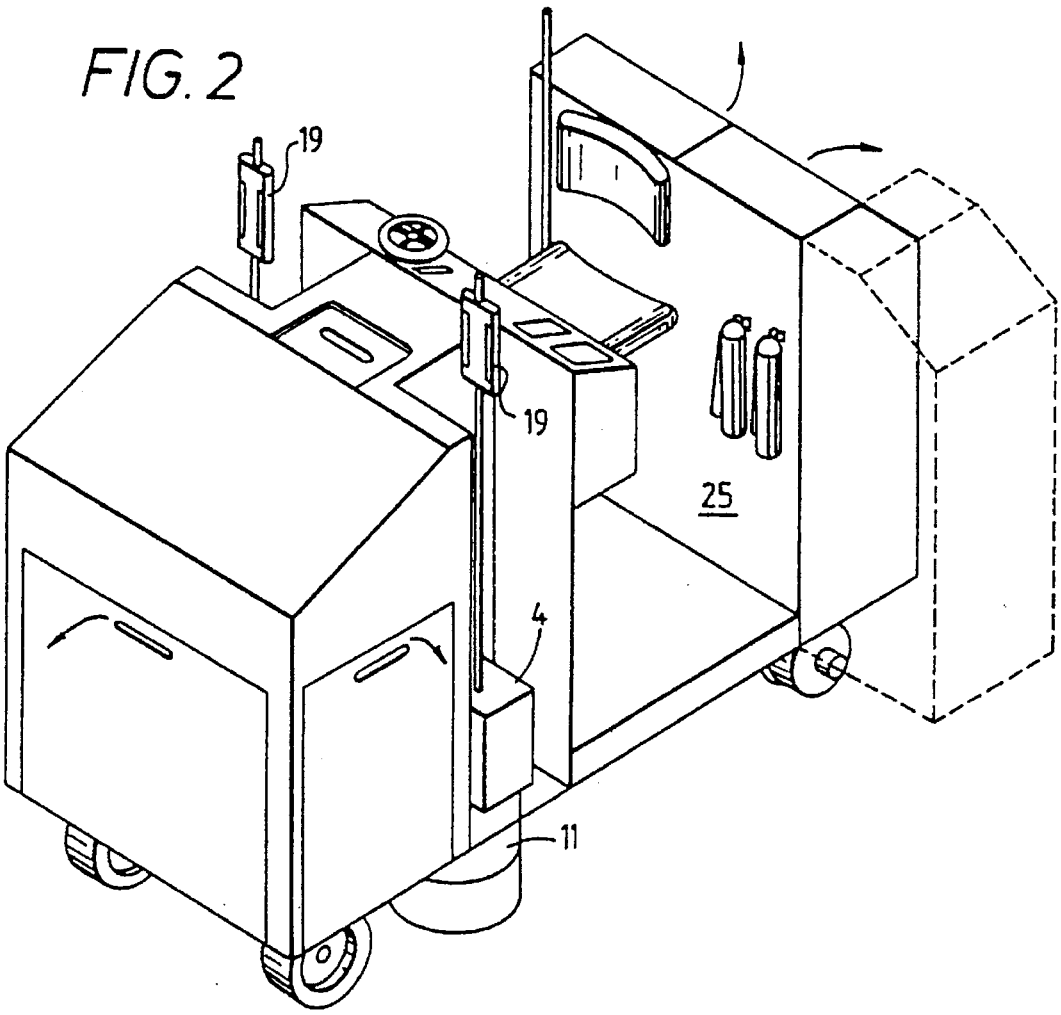
FIG. 2 is a general outside view of the same vehicle.
Figure 3:
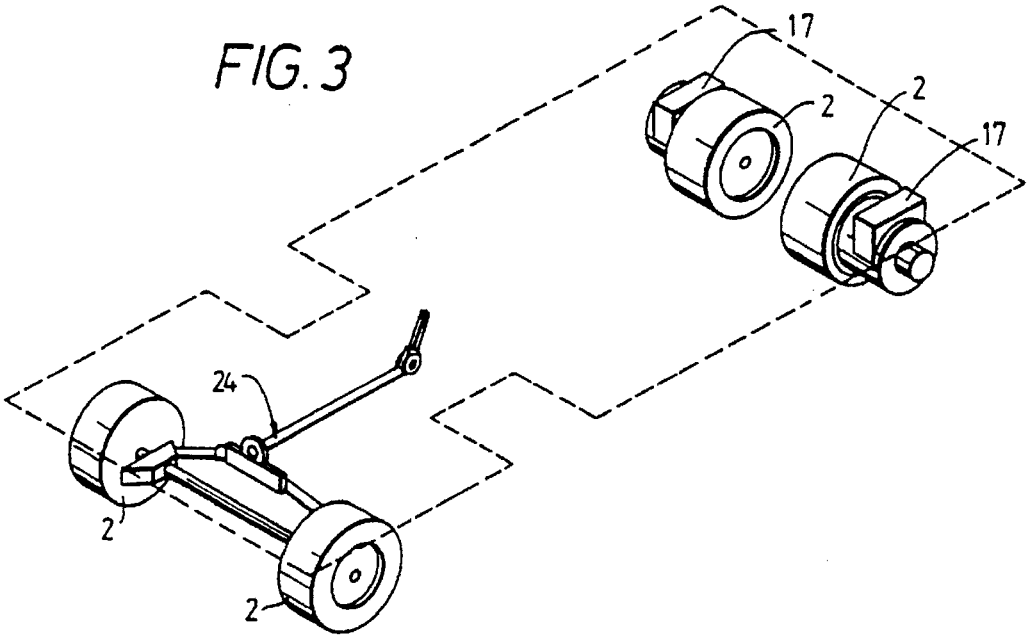
FIG. 3 shows its propulsion and steering means.
Figure 4:
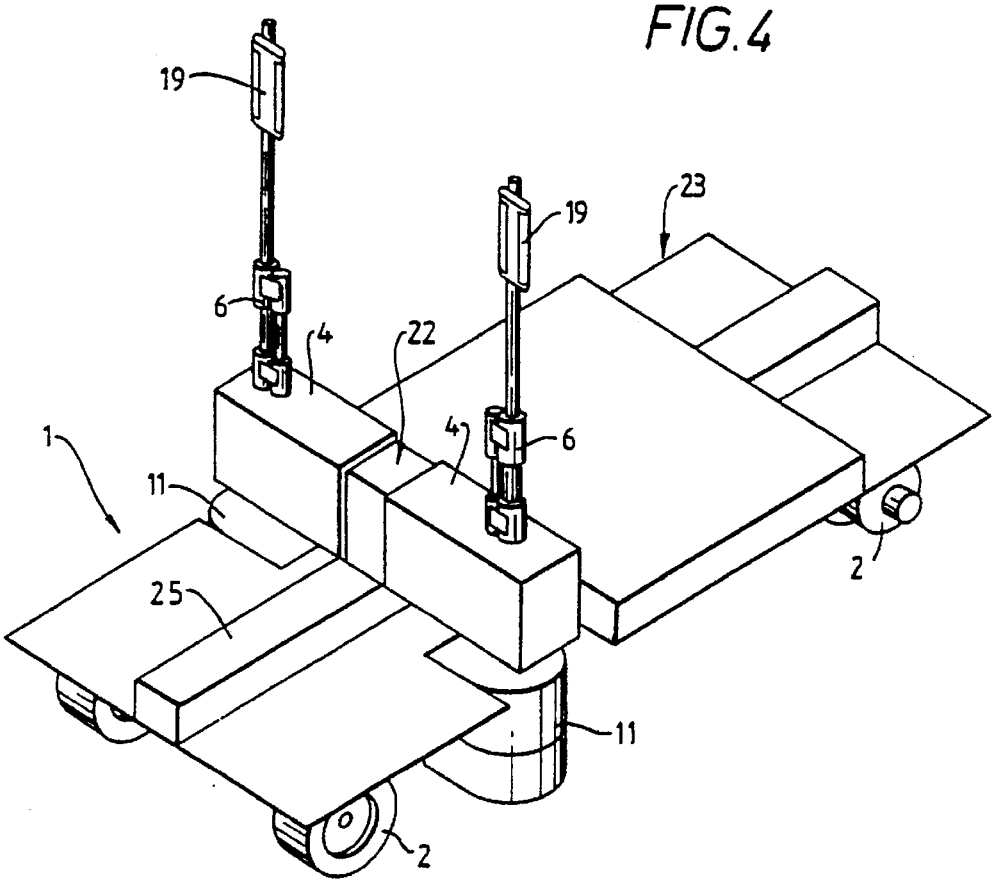
FIG. 4 shows, greatly simplified, main structural elements of the same vehicle.

Referring to FIG. 1, a mobile floor grinding vehicle comprises a body indicated in phantom lines at 1, carried by wheels 2 on which it is movable over a floor 3. At least one rigid, transverse support beam 4 is supported rigidly by the body 1 and is movable vertically in the latter as indicated by the arrow 5. This movement is effected by any suitable means, for example a hydraulic piston and cylinder actuator 6.

The beam 4 defines a vertical plane 7, and is mounted for limited rotation on the body 1 about a horizontal transverse axis 8 in the plane 7. This rotation is effected by any suitable means, for example by gravity or by a rotary actuator, which is indicated at 9 and which is controlled by a level sensor 10 in such a way as to maintain the plane 7 of the beam 4 vertical at all times. The reason for this will be apparent later.

A grinding head 11 is secured rigidly to the beam 4 so that its attitude and vertical position faithfully follow those of the beam 4. The head 11 includes a casing 12 to which a drive motor 13 is securely fastened.

A rotary floor grinding wheel 14, of any suitable type, within the casing 12, is driven through a shaft 15 by the motor 13, its axis of rotation 16 being contained in or parallel to the plane 7.

The vehicle includes control means for the vertical movement of the beam 4 in response to predetermined input signals to control the vertical position of the grinding wheel 14 as the vehicle is propelled over the floor 3, by any suitable propulsion means 17 driving a pair of the wheels 2.

The control means comprise a hydraulic control unit 18 which controls the actuator 6. The vehicle has two different systems for supplying the above-mentioned input signals to the control unit 18. The first of these comprises a laser beam sensor 19 which detects a horizontal beam 20 transmitted from a laser fixed in a suitable position up to, for example, about 300 meters from the vehicle.

The beam 20 defines a predetermined datum level, and given that the floor 3 is intially undulating, then as the vehicle travels over the floor the horizontal level of the beam 20 with respect ot the sensor 19 will vary. This variation produces, in any known manner, a varying input signal to the unit 18 which operates the actuator 6 in such a way that the head 11, and therefore the grinding wheel 14, remains at a constant vertical distance from the laser beam 20.

The other system for energising the unit 18 essentially comprises a computer 21, which is linked with the propulsion means 17 so as to provide input signals to the unit 18 that vary in accordance with the initial contours of the floor, preprogrammed into the computer. This preprogramming can be carried out in any known manner, for example by the use of the plotting device known as a PROFILERGRAPH. The signals supplied by the computer 21 represent an analogue of the contours plotted by this device, the computer detecting the progress of the vehicle as it retraces the path previously followed by the plotting device.

The embodiment shown in FIGS. 2 to 7 has two grinding heads 11, one on either side of the vehicle and carried by a telescopic, rigid, transverse beams 22 which incorporates the two corresponding beams 4, adjustable for transverse spacing so as to position the grinding wheels 14 at any desired track width. Associated with each head 11 is a separate sensor 19 and associated means for controlling the vertical position of the grinding wheels 14, e.g. control unit 18 (in this case a hydraulic piston), and actuator 6.

The body 1 includes a chassis 23 supported on the wheels 2, the front pair of which are idle and steerable by a conventional steering linkage 24, while the rear wheels 2 are driven by independent electric motors 17. The chassis 23 carries a cockpit 25 for the operator, with electric batteries, for supplying power to the motors 17 and the control equipment, being mounted behind the cockpit. The level sensor 10 is mounted on top of the telescopic beam 22. The latter is supported rigidly, by means not shown, on a rigid longitudinal main support beam 26 of the chassis. It should be noted that the track width between the two rear wheels is in this example narrow enough to keep them out of the path of the grinding wheels 14.

Figure 5:
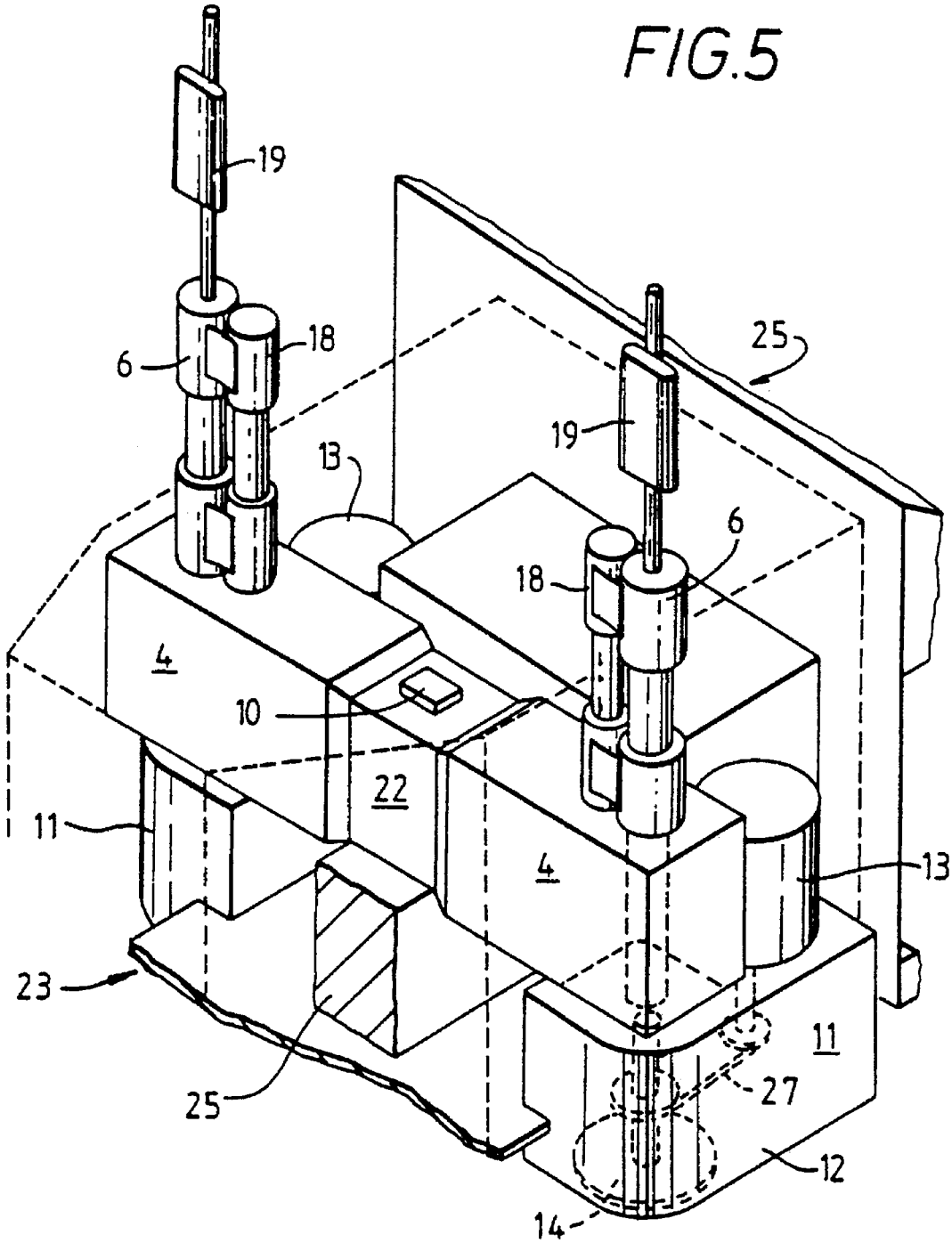
FIG. 5 shows how grinding heads are mounted on the vehicle of FIGS. 1 to 4.
Figure 6:
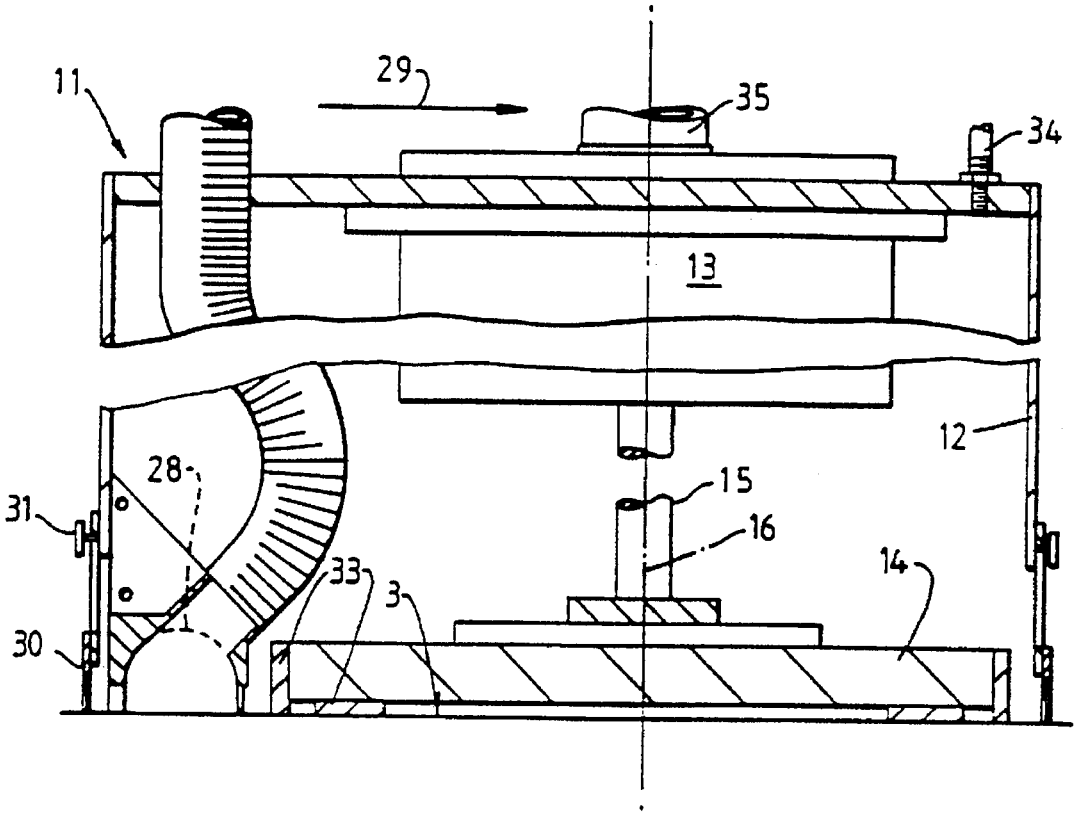
FIG. 6 is a simplified cross sectional elevation through a grinding bead.
Figure 7:
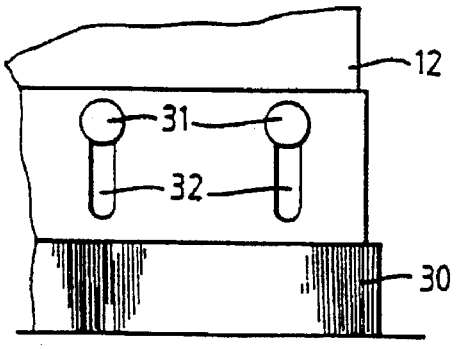
FIG. 7 is an outside elevation of a small part of the grinding head as seen from the left-hand side of FIG. 6.

The hyraulic motor 13 of each grinding head 30 may be in line with the grinding wheel axis 9, or offset from it so as to drive the grinding wheel through a belt drive 27 FIG. 5 Each grinding head casing 12 contains vacuum dust removal head 28, mounted behind the grinding wheel 14, the direction of travel being indicated at 29 in FIG. 6. A rubber dust skirt 30 extends around the bottom casing 12 in contact with the floor, being carried on studs 31 fixed to the casing 12, and freely movable up and down by means of slots 32 by which it is supported on the studs 31.

The embodiment just described is arranged to grind a pair of parallel tracks, accurately levelled, in a floor. There may, however, be any number of grinding heads, and they may be so arranged that they together grind the floor over the whole width of the vehicle, so that an entire floor surface can eventually be levelled. It will be understood that the grinding heads can take any suitable form. As shown, each grinding wheel 16 has diamond grinding rings 33, the casing 12 being effectively sealed and having, besides the features mentioned above, an inlet 34 for water under pressure. In FIG. 6, the piston of the associated actuator 6 is indicated at 35, being securely bolted to the top of the casing 12.

It will be understood that as the vehicle pitches longitudinally or tilts sideways as its wheels 2 pass over the undulating floor surface, the sensor 10 maintains the grinding wheel axes 16 vertical at all times.

Figure 8:
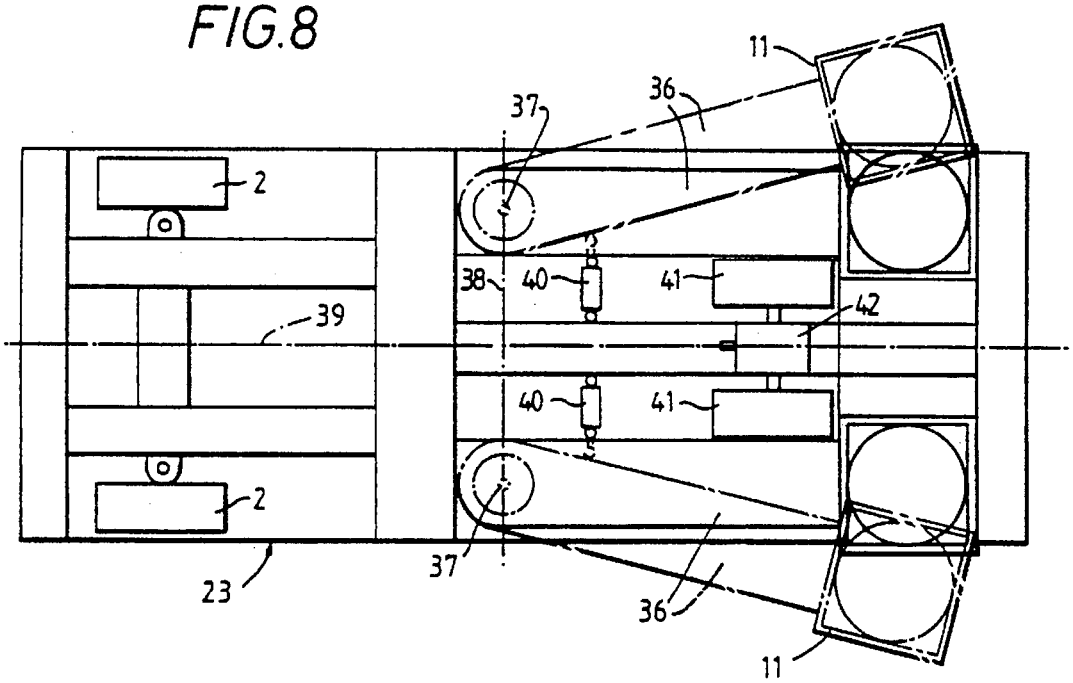
FIGS. 8 and 9 are diagrammatic views, in plan and elevation respectively, showing parts of a mobile floor grinding vehicle in a second embodiment.
Figure 9:
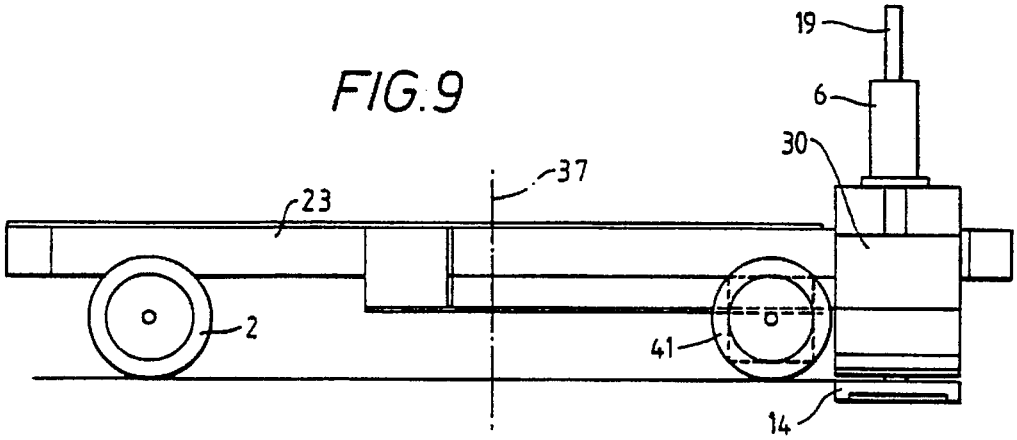

Referring now to FIGS. 8 and 9, the vehicle of which some parts are shown here differs from that described above mainly in that, instead of being carried by the transverse telescopic beam, each grinding head 11 is carried on the free end of a corresponding rigid support arm 36, which is supported on the vehicle chassis 23, by means of a pivot having a pivotal axis 37. The pivotal axes 37 of the arms 36 lie on a common transverse axis 38 with respect to the longitudinal axis 39 of the chassis 23.

Pivoting of each arm 36 is controlled by a cylinder-type actuator 40 mounted transversely on the chassis 23.

FIG. 8 shows one support arm 36 and head 11 on each side of the chassis 23, illustrated both in their parked position with the beam parallel with the chassis, and in a swungout position. The head 11 is operative in all beam positions.

The chassis 23 may be arranged with further grinding heads 11, each with its own support arm 36 and actuator 40, mounted in front of and/or behind those shown. Any support arm 36 can be arranged to swing inwards as well as (or instead of) outwards. Each support arm 36 can be arranged to carry more than one head 11. The equipment carried by each support arm 36, to raise and lower the grinding heads 11 is generally the same in construction and operation as that carried by a support beam 4 in FIGS. 1 to 7, e.g. cylinder actuator 6 operating to reciprocate the head 11 in response to signals received from the control unit 18.

The embodiment of FIGS. 8 and 9, by contrast with the previous embodiment, has front traction wheels 41 as the driving wheels, with the rear wheels 2 being steerable by a conventional steering mechanism, not shown. A liquid petroleum gas (LPG) combustion engine, not shown, supplies hydraulic power to hydraulic traction motors 42 driving the wheels 41, and also to the control equipment of the grinding heads 11. It will, however, be understood that, in any embodiment, either the front or the rear wheels may be steerable; and that in any embodiment traction may be electric or hydraulic.

Figure 10:
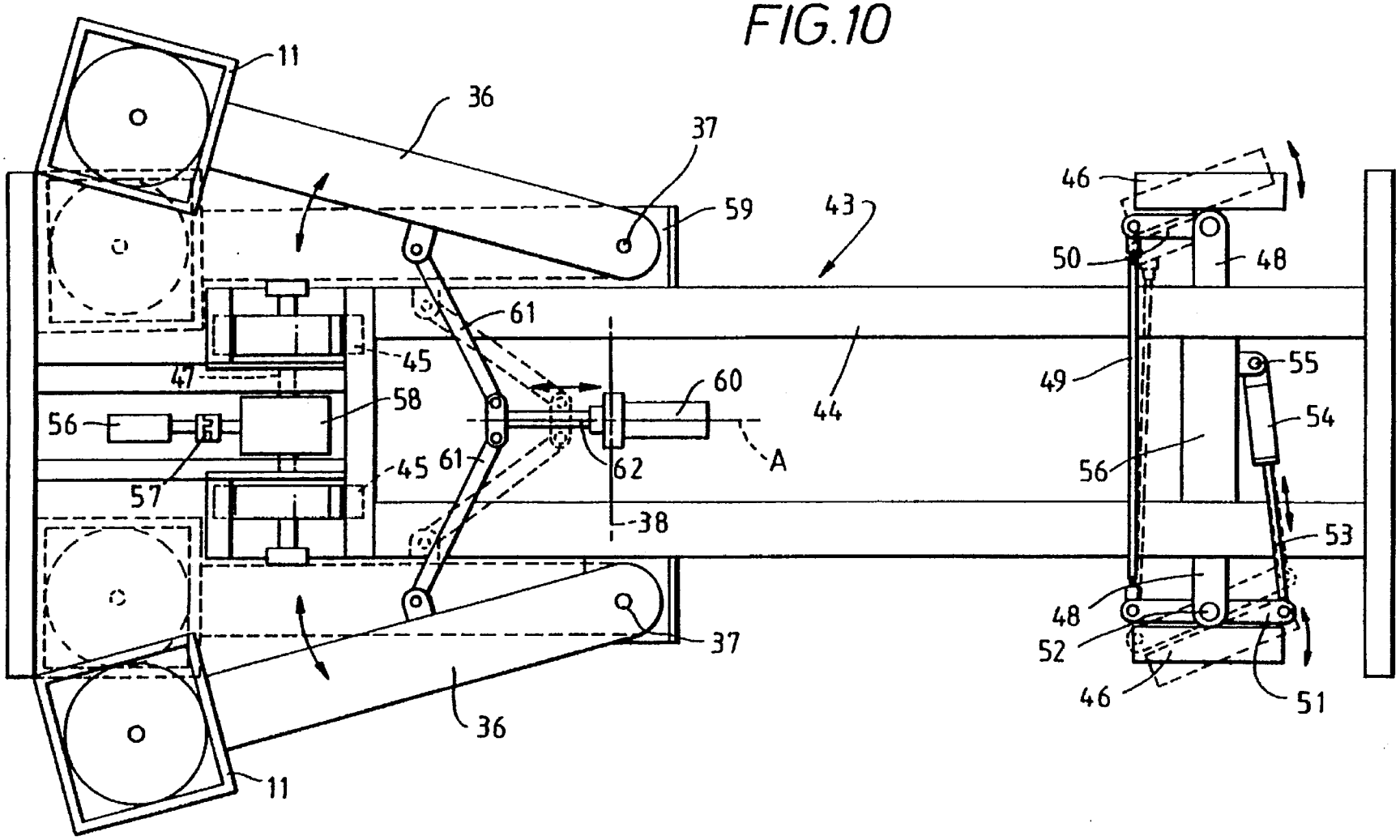
FIG. 10 is a plan view in diagrammatic form of a mobile floor grinding vehicle according to a still further embodiment of the invention.
Figure 11:
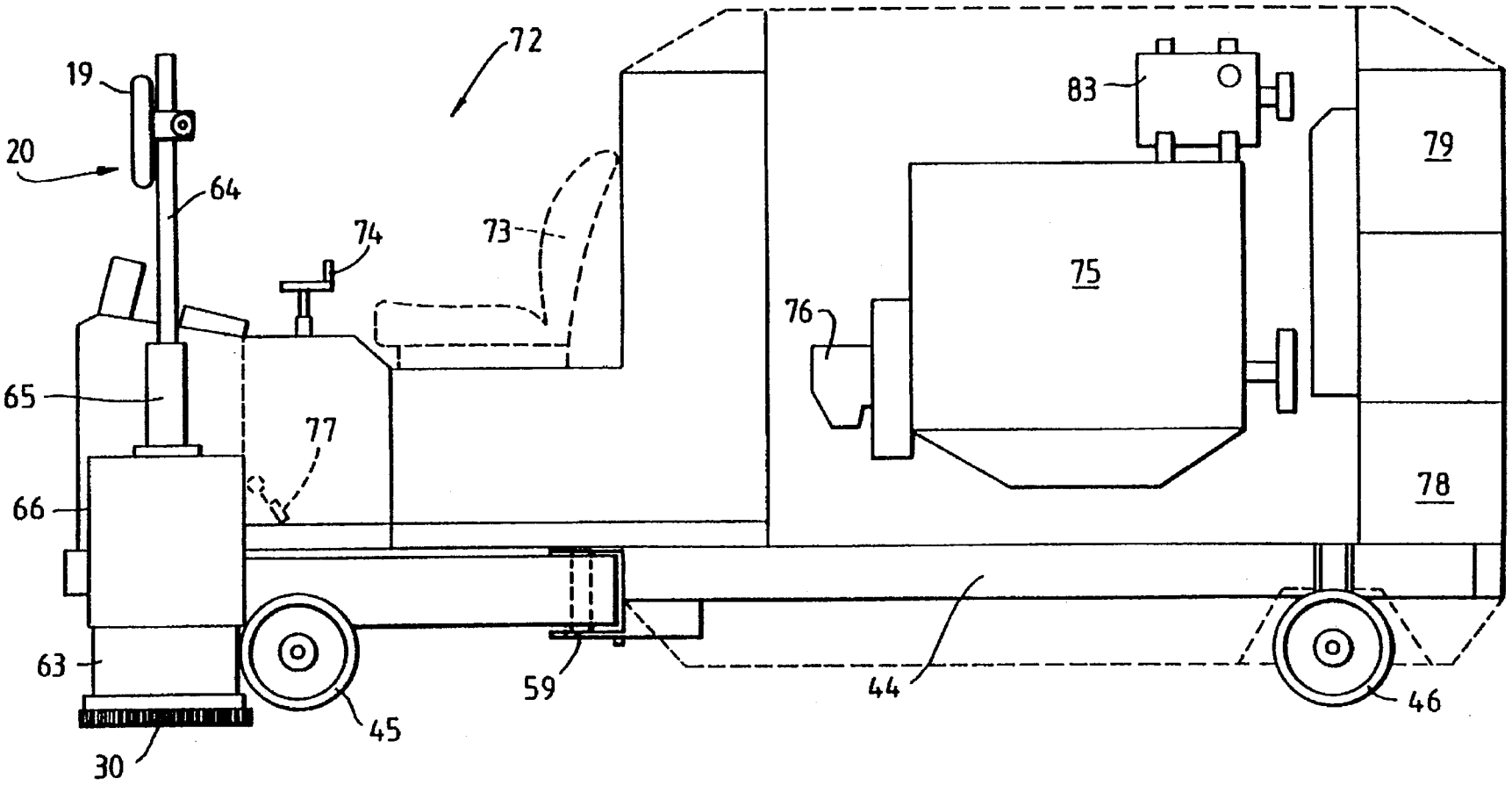
FIG. 11 shows, in diagrammatic form, an elevation view of the vehicle of FIG. 10.
Figure 12:
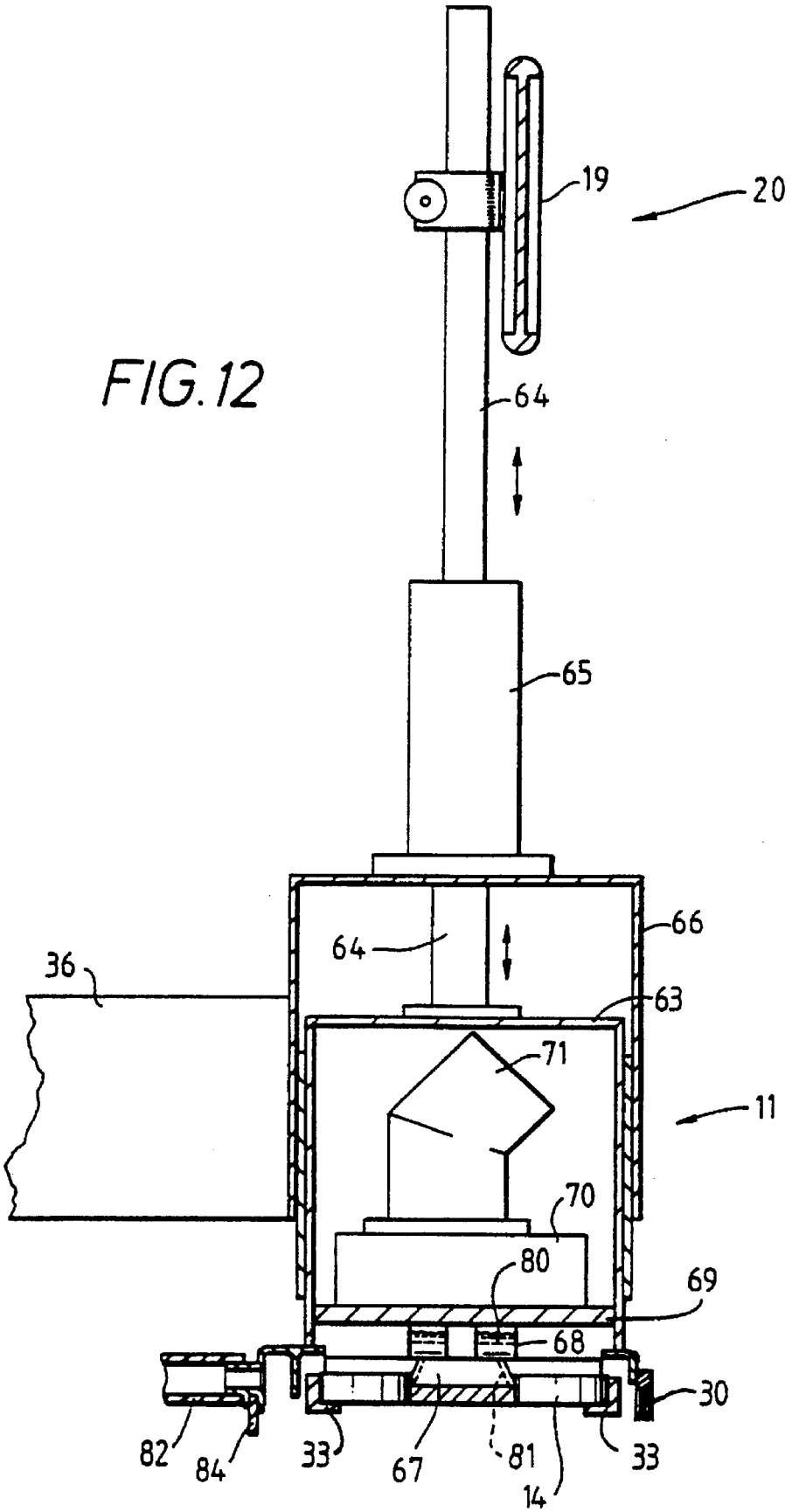
FIG. 12 is a section through the grinding head of the embodiment shown in FIGS. 10 and 11.

A further embodiment of the invention is shown in FIGS. 10 to 12. In this embodiment, those component parts which are the same as in previous embodiments will have the same reference numbers.

This further embodiment comprises a chassis 43 formed of two rigidly spaced beams 44 provided with front driving wheels 45 and steerable trailing wheels 46. The front wheels 45 are mounted on a drive axle 47 rotatably mounted between the rigid beams 44 of the chassis 43. The drive wheels 45 are more closely spaced with respect to the central axis A of the chassis 43 than the rear wheels 46 and less than the track width to be ground by the grinding wheels 14 of the grinding heads 11.

The rear wheels 46 are provided to steer the vehicle and to this end are rotatably mounted on stub axles 48 projecting from the chassis beams 44.

A connecting rod 49 is pivotally mounted between two pivoting arms 50, 51, both of which are pivotally mounted to a pivot 52 on the stub axles 48. The arm 51 extends to the other side of its associated stub axle 48 and is connected to the piston rod 53 of a piston 54 pivotally mounted at 55 to a rigid strut 56 fixed between the two beams 44. As will be appreciated hydraulic actuation of the piston 54 through the steering mechanism of the vehicle, not shown in detail, causes the wheels 46 to pivot on the stub axles 48 thus enabling the vehicle to be steered over the ground.

Power to drive the vehicle is supplied to the front wheels 47 by means of a hydraulic motor 56 acting on drive gear 57 coupled to the wheels 45 through a drive coupling 58.

In this embodiment the support arms 36, see FIG. 10, are pivotally mounted on rigid support pieces 59 which project from the chassis beams 44. In this way the support arms 36 are able to be brought into abutment with the beams 44 in their parked position as shown in dotted outline in FIG. 10.

The support arms 36 are pivotally movable between the said parked position and a maximum swung-out position as shown in full outline in FIG. 10. As in the FIGS. 8 and 9 embodiment, the pivotal axes of the arms 36 on the support pieces 59 lie on a common transverse axis 38 with respect to the longitudinal axis A of the chassis 43.

Actuation of the support arms 36 is effected by means of a hydraulic piston 60 mounted on the chassis 43 such that the rod 62 thereof operates along the longitudinal central axes of the chassis 43. The piston 60 acts on two control arms 62 of equal length pivotally mounted at one end of each thereof to the end of the rod 62 of the piston 60 and at the other ends respectively to the rigid support arms 36 at equal distances from the respective pivot points on the support pieces 59.

By means of this symmetrical arrangement, the arms 36 may be moved outwardly upon actuation of the piston 60 by equal amounts at the same rate of travel such that the grinding heads 11 may be positioned to effect a grinding operation at equal distances from the longitudinal central axis A of the chassis 43.

As with the FIGS. 8 and 9 embodiment, the grinding heads 11, see FIG. 12, are formed of a box structure having an inner box part 63 carrying the grinding wheel 14 and connected to the rod 64 of a piston 65 the cylinder of which is attached to an outer box part 66 of the box structure, and within which the inner box part 63 is able to reciprocate upon actuation of the piston 65.

The top of the piston rod 64 carries the laser responsive receiver 19, adjustably mounted thereon, signals from which caused by variations of movement with respect to laser beam 20 are used to actuate the piston 65 through a control unit of the type 18 described with reference to FIGS. 1 to 7.

Each grinding wheel 14, see FIG. 12, is mounted to a drive plate 67 connected to a drive shaft 68. The drive shaft 68 revolves in a bearing 70 attached to a bottom wall 69 of the inner box part 63 and is driven by means of a drive motor 71.

With reference now to FIG. 11, the vehicle is provided with a forward cockpit area 72 having a drivers seat 73 suitable positioned therein. A steering wheel 74 is provided in the cockpit 72 hydraulically coupled to the piston 54 operating the rear wheels 46 by suitable means, not shown, for steering the vehicle.

The vehicle is provided with a power pack in the form of a diesel engine 75 coupled to a hydraulic pump 76 which powers the hydraulics of the system through a controllable valving arrangement, not shown, such as the hydraulic motor 56, and pistons 54, 60 and 65, and thus travel of the vehicle, steering, position of support arms 36, and height adjustment of the grinding heads 11 respectively. All these operations may be effected from the cockpit 72 using control equipment of conventional design and familiar to one skilled in the art. The speed of the vehicle is controlled by accelerator pedal 77, coupled to the engine 75.

To the rear of the vehicle is mounted a diesel fuel tank 78 and a hyraulic oil storage tank 79.

To maintain the grinding area clear of ground dust and other debris, clean water is fed from an external source (not shown) to a water reservoir 80 above the grinding wheels 14, see FIG. 12. The clean water is delivered to the grinding area as required via water outlets 81. Dirty water and debris may be withdrawn from the grinding area to a dirty water collection tank (not shown) by means of a line connector 82. The dirty water collection tank is caused to function using a vacuum unit 83 mounted adjacent to the engine 75 and operated thereby. The action of removing dirty water from the grinding area is assisted by means of a rubber squeegee device 84 arranged around the grinding head, shown more particularly in FIG. 12.

We claim:

1. A mobile floor grinding vehicle comprising a vehicle body having two sides and movable in a predetermined direction of travel over a floor, a rigid support arm mounted pivotally to each side of said vehicle body and having a free end, a grinding tool being mounted at the free end of each of said pivotally mounted support arms, drive means for driving each grinding tool to grind the floor to a desired contour, means coupled to the support arms for operating the support arms to position the grinding tools in respective grinding positions on the floor, so that a pair of parallel tracks may be formed in the floor by said grinding tools to a said desired contour, means for providing a set of values representative of said desired contour and control means for controlling the grinding depth of each grinding tool with respect to the floor in response to predetermined signals derived from said set of values.

2. A vehicle as claimed in claim 1 wherein said operating means includes an actuating mechanism mounted between said support arms for separating said arms at an equal rate such that the grinding tools may be positioned at equal distances to either side of a central longitudinal axis of the vehicle.

3. A vehicle as claimed in claim 2 wherein said actuating mechanism comprises a pair of connecting rods of equal length pivotally connected together at one end of each thereof and each to a respective one of said support arms at an equal distance from the pivot points of the support arms which pivot points lie on a common transverse axis with respect to said central longitudinal axis of the vehicle, and means mounted on said vehicle body for moving the pivotally connected ends of said rods along said central longitudinal axis of said vehicle.

4. A vehicle as claimed in claim 3 wherein said moving means is a hydraulically operable piston.

5. A vehicle as claimed in claim 4 wherein a said grinding tool is mounted for reciprocating movement in a housing at the end of each of said pivotal arms whereby in response to said predetermined signals the grinding tools may be maintained at a grinding depth corresponding to a said desired contour to be ground in the floor.

6. A mobile floor grinding vehicle comprising a vehicle body movable in a predetermined direction of travel over a floor, a pair of grinding tools supported by the body placed with a spacing in between them, drive means for driving each grinding tool to grind the floor to a desired contour, means for providing a set of values representative of said desired contour and control means for controlling the grinding depth of each grinding tool with respect to the floor in response to a predetermined signal derived from said set of values, each grinding tool being mounted on a transverse beam mounted for reciprocating movement on the vehicle body by said control means so as to vary the position of the grinding tool with respect to the floor to be ground, and wherein said transverse beam is telescopic thereby to vary the transverse distance or spacing between the grinding tools mounted thereon.

7. A vehicle as claimed in claim 6 wherein said transverse beam is mounted for limited rotatable movement about a horizontal axis, and level sensor means attached to the beam whereby to maintain the beam at a desired rotational position.

8. A vehicle as claimed in claim 1 wherein said predetermined signals are provided by an on-board computer pre-programmed with data representing the initial contour of the floor at any position thereon and said desired contour thereat, said predetermined signals varying in response to variations between said initial contour and said desired contour as the grinding tools move over the floor to control said grinding depth.

9. A vehicle as claimed in claim 1 wherein a laser beam responsive sensor is connected to each said grinding tool for movement therewith, and means for adjusting the grinding position of each said grinding tool to said grinding depth in response to signals from said sensor representative of a datum level provided by a laser beam directed onto a said sensor from a chosen position remote from the vehicle.

10. A vehicle as claimed in claim 9 wherein said adjustment means is a hydraulically operable piston for each grinding tool, the rod of which piston is connected to a respective grinding tool and carries a said laser beam responsive sensor thereon.

11. A vehicle as claimed in claim 6 wherein at least one laser beam responsive sensor is mounted on said transverse beam, said control means adjusting the position of said transverse beam and thus each said grinding tool to said grinding depth in response to signals from said sensor representative of a datum level provided by a laser beam directed onto a said sensor from a chosen position remote from the vehicle.

12. A vehicle as claimed in claim 6 wherein said predetermined signals are provided by an on-board computer pre-programmed with data representing the initial contour of the floor at any position thereon and said desired contour thereat, said predetermined signals varying in response to variations between said initial contour and said desired contour as the grinding tools move over the floor to control said grinding depth.

* * * * *

UNITED STATES PATENT AND TRADEMARK OFFICE

CERTIFICATE OF CORRECTION

PATENT NO. : 5,643,047

DATED : July 1, 1997

INVENTOR(S) : Leonard James Beckett

It is certified that error appears in the above-indentified patent and that said Letters Patent is hereby corrected as shown below:

Column 2, line 23: Delete "bead" and insert --head--; and

Column 5, line 25: Delete "62" and insert --61--.

Signed and Sealed this

Fourteenth Day of October, 1997

*Attest:*

*Attesting Officer*

BRUCE LEHMAN

*Commissioner of Patents and Trademarks*